US006955290B2

(12) United States Patent
Wende

(10) Patent No.: US 6,955,290 B2
(45) Date of Patent: Oct. 18, 2005

(54) FOLDING BOX

(75) Inventor: Lucien Wende, Mosbach (DE)

(73) Assignee: CD Cartondruck AG, Obersulm (DE)

( * ) Notice: Subject to any disclaimer, the term of this patent is extended or adjusted under 35 U.S.C. 154(b) by 151 days.

(21) Appl. No.: 10/716,139

(22) Filed: Nov. 17, 2003

(65) Prior Publication Data

US 2005/0029336 A1 Feb. 10, 2005

(30) Foreign Application Priority Data

Dec. 2, 2002 (DE) ..... 202 18 726 U
Dec. 2, 2002 (EP) ..... 02027003

(51) Int. Cl.[7] ..... B65D 5/42
(52) U.S. Cl. ..... 229/129.1; 229/122.32; 229/185.1
(58) Field of Search ..... 229/122.32, 122.33, 229/125.125, 129.1, 185.1, 220

(56) References Cited

U.S. PATENT DOCUMENTS 3,317,112 A * 5/1967 Futterman ..... 229/129.1
3,987,955 A * 10/1976 Saarinen ..... 229/220
4,267,926 A * 5/1981 Toimil ..... 229/129.1
4,524,901 A * 6/1985 Tikka ..... 229/220
4,641,777 A * 2/1987 Fronduti ..... 229/122.32
4,671,449 A * 6/1987 Fronduti ..... 229/129.1
6,016,952 A * 1/2000 Smith et al. ..... 229/185.1
6,168,073 B1 * 1/2001 Towle ..... 229/125.125

FOREIGN PATENT DOCUMENTS

EP 1 048 577 A1 11/2000
FR 2 785 872 A1 5/2000

* cited by examiner

*Primary Examiner*—Gary E. Elkins
(74) *Attorney, Agent, or Firm*—Darby & Darby

(57) ABSTRACT

A folding box (10) has a polygonal outer contour unit (12), which is closed in cross section and has outer wall elements (30.1, 30.2, 30.3, 30.4) connected via outer-contour folding lines (32), a lid unit (18), a base unit (20), and a reclosable removal opening (80). The box includes a bottom inner contour unit (14), regions of which are polygonal in cross section and which has bottom inner wall elements (40.1, 40.2, 40.3) connected via bottom inner-contour folding lines (42.1, 42.2). The bottom inner contour unit is present in a folded state in the interior of the outer contour unit (12) and is connected to the outer contour unit (12) via a connecting folding line (28). The box further has a polygonal top inner contour unit (16) which is closed in cross section, has a removal opening (80) and top inner wall elements (50.1, 50.2, 50.3, 50.4) connected via top inner-contour folding lines (52.1, 52.2, 52.3). The top inner contour unit also is present in a folded state in the interior of the outer contour unit (12). There is at least one connecting folding tab (60). The folding or stretching of the connecting folding tab (60) permits a relative displacement of the top inner contour unit (16) relative to the outer contour unit.

15 Claims, 9 Drawing Sheets

FOLDING BOX

TECHNICAL FIELD

The present folding box relates to a folding box having a polygonal outer contour unit, closed in cross section and having outer wall elements connected via outer-contour folding lines, a lid unit, a base unit, and a reclosable removal opening.

PRIOR ART

Folding boxes having reclosable removal openings are known. Such conditions serve to be able to remove the filling material in a simple manner as often as desired. Suitable filling materials are, for example, liquid drops, pastilles, tablets or the like.

DESCRIPTION OF THE INVENTION

The object or the technical problem underlying the present invention is to specify a folding box which can be produced from a one-piece blank, can be transported to the filler in a state folded flat, can be set up in a simple manner for filling and permits simple manipulation for opening or closing the removal opening.

The folding box according to the invention is provided for by the features of independent claim 1. Advantageous configurations and developments are the subject matter of the claims which are directly or indirectly dependent upon claim 1.

Accordingly, the folding box according to the invention comprises a bottom inner contour unit, regions of which are polygonal in cross section and which has bottom inner wall elements connected via bottom inner-contour folding lines and which is present in a folded state in the interior of the outer contour unit and is connected to the outer contour unit via a connecting folding line, a polygonal top inner contour unit which is closed in cross section, has the removal opening and has top inner wall elements connected via top inner-contour folding lines and which is present in a folded state in the interior of the outer contour unit, at least one connecting folding tab which connects the bottom inner contour unit and the top inner contour unit to one another and can be folded into the interior of the folding box, the folding or stretching of the connecting folding tab permitting a relative displacement of the top inner contour unit relative to the outer contour unit, the removal opening being closed by the outer contour unit when the top inner contour unit is pushed into the outer contour unit, the removal opening being opened in the pulled-out state of the top inner contour unit, and the outer contour unit forming a displacement guide for the top inner contour unit.

An especially compact embodiment is distinguished by the fact that the sum of the lengths of the top and bottom inner contour units corresponds to the length of the outer contour unit.

With a compact construction being maintained and while ensuring simple manipulation, an especially advantageous configuration is distinguished by the fact that the outer contour unit has at least one marginal recess open at the top, a preferred development having a total of two marginal recesses which are present opposite one another on the outer contour. By the provision of the marginal recesses, regions of the outer wall of the top inner contour unit are accessible from outside. To open the folding box, these accessible regions are taken hold of in a simple manner, as a result of which the top inner contour unit can be pulled out of the outer contour unit to a certain extent, depending on the length of the connecting folding tab, as a result of which the removal opening is cleared. The removal opening is closed by simply pushing the top inner contour unit into the outer contour unit.

In order to increase the stability of the entire folding box, an especially advantageous embodiment variant is distinguished by the fact that an outer-contour adhesive tab is attached to the outer contour unit via an adhesive-tab folding line and is designed as a full-surface wall element.

An advantageous configuration which has permanent reliable functioning with regard to the displacement of the top inner contour unit is distinguished by the fact that the connecting folding tab is attached to the bottom inner contour unit via a first connecting folding line and to the top inner contour unit via a second connecting folding line, the connecting folding lines being arranged perpendicularly to the inner folding lines, the connecting folding tab preferably having a centrally arranged inner folding line.

With regard to a one-piece blank, a preferred embodiment variant is distinguished by the fact that, on the top side, lid folding tabs forming the lid unit are integrally formed on the top inner contour unit via lid folding lines and/or that, on the underside, base folding tabs forming the base unit are integrally formed on the bottom inner contour unit via base folding lines.

An embodiment variant which is practical in terms of manipulation is distinguished by the fact that the outer contour unit has a quadrilateral cross section having four outer wall elements, the bottom inner contour unit has a U-shaped cross section having three bottom inner wall elements, and the top inner contour unit has a quadrilateral cross section having four top inner wall elements, the dimensions of the inner contour units being slightly smaller than the dimensions of the outer contour unit.

An embodiment variant which permits an especially simple folding operation, permits a simple blank and offers permanently reliable functioning is distinguished by the fact that the width of the connecting folding tab corresponds to the width of the top and bottom inner wall elements, respectively. In this case, in an embodiment variant having a quadrilateral cross section, it is especially advantageous according to a preferred embodiment variant to provide two connecting folding tabs, which are integrally formed on the top and bottom inner contour units at a distance apart by the dimension of the width of an inner wall element lying in between.

In the embodiment variant in which the lid unit is integrally formed on the top inner contour unit on the top side, the lid unit is preferably of adhesively bonded design, so that deliberate opening of the lid unit when pulling out the top inner contour unit is not possible.

Carton can preferably used as material for the folding box.

The folding box according to the invention offers a multiplicity of advantages. It can be produced in a simple manner from a simple carton blank. By simple folding operations with parallel or subsequent adhesive bonding, it is possible to fold the folding box into a flat transport state at the folding box manufacturer's. The folding box can be transported to the filler in this flat, space-saving state. After being set up, the folding box, once the base unit has been closed, can then be filled with filling material in a simple manner. The folding box is ready for use after the lid unit has been closed. Owing to the fact that the top inner contour unit has contour dimensions which are only slightly smaller than the contour dimensions of the outer contour unit, the top inner contour unit is held in a clamping manner inside the outer contour unit. To pull out or push in the top inner contour unit, only this clamping effect, which in practical manipulation is not selected to be too large, merely has to be overcome.

Further embodiments and advantages of the invention follow from the features additionally recited in the claims and from the exemplary embodiments specified below. The features of the claims can be combined with one another in any desired manner insofar as they are not obviously mutually exclusive.

BRIEF DESCRIPTION OF THE DRAWING

The invention and advantageous embodiments and developments of the same will be described and explained in more detail below with reference to the examples shown in the drawing. The features which can be gathered from the description and the drawing can be used individually on their own or a plurality of them can be used in any desired combination. In the drawing:

FIG. 8 shows a perspective representation of the folding box according to FIG. 7 with top inner contour unit pushed in.

WAYS OF IMPLEMENTING THE INVENTION

Figure 1:
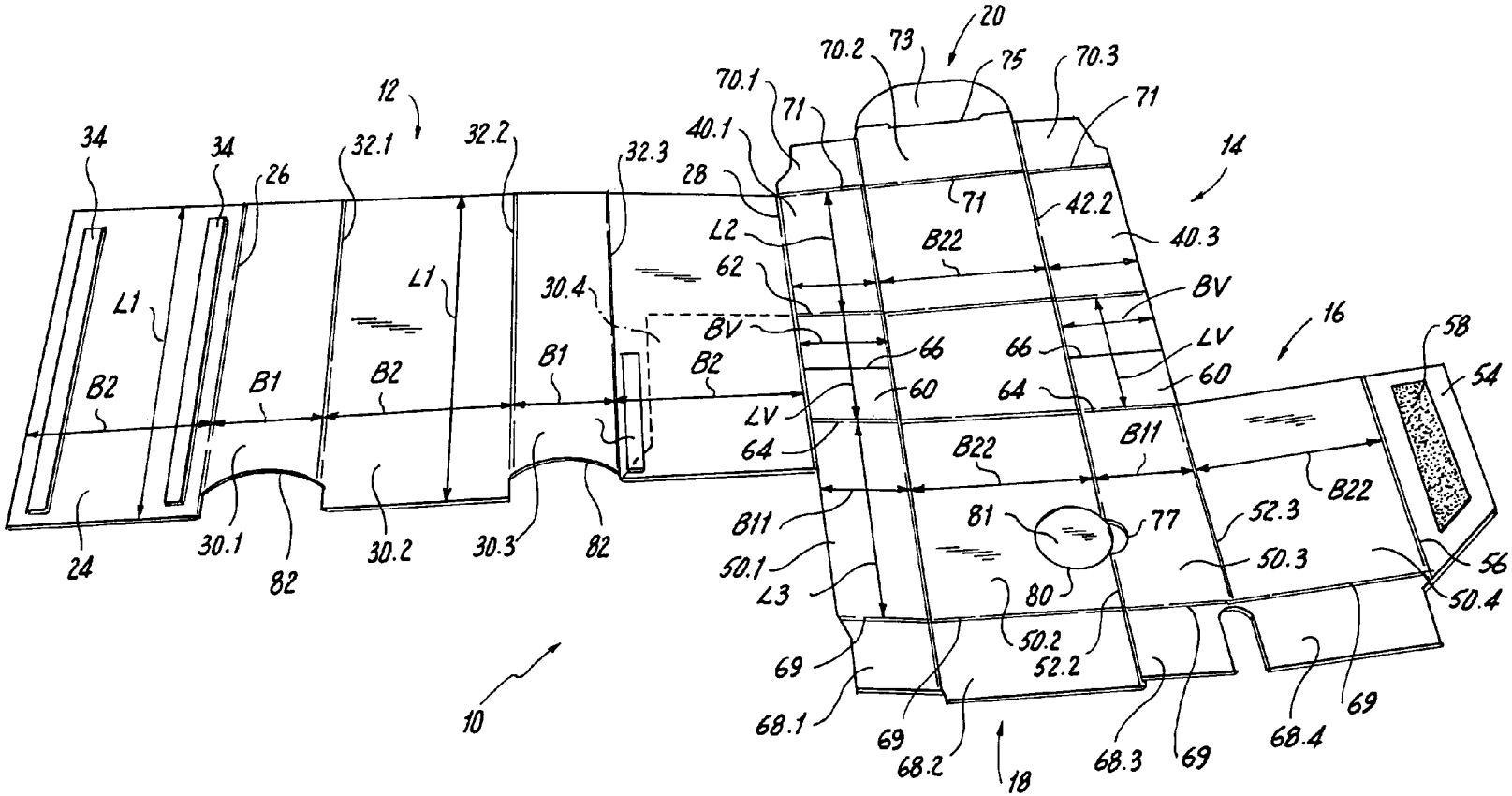
FIG. 1 shows a perspective representation of the one-piece blank of a folding box having an outer contour unit, a bottom inner contour unit and an inner contour unit which is longitudinally displaceable in the folded state of the folding box.

The blank of a folding box 10 shown in FIG. 1—as carton in the exemplary embodiment—has an outer contour unit 12 which can be folded into a rectangular cross section. In this case, there is a first outer wall element 30.1, a second outer wall element 30.2, a third outer wall element 30.3 and a fourth outer wall element 30.4. The outer wall elements 30.1, . . . are connected to one another at their adjacent longitudinal margins via outer-contour folding lines 32.1, 32.2, 32.3. All the outer wall elements 30.1, . . . have a length L1. The width of the first and third outer wall elements 30.1, 30.3 is designated in FIG. 1 by B1 and the width of the second and fourth outer wall elements is designated in FIG. 1 by B2. On the left-hand outer longitudinal margin of the outer wall element 30.1 in FIG. 1, an adhesive tab 24 is integrally formed by an adhesive-tab folding line 26, this adhesive tab 24, from its dimensions, likewise being designed as a wall element having a length L1 and a width B2.

An adhesive strip 34 running over the length L1 is in each case present on the top side in both the right-hand longitudinal margin region and the left-hand longitudinal margin region of the outer-contour adhesive tab 24. These two adhesive strips may also alternatively be arranged on the rear side of the fourth outer wall element 30.4.

On the free right-hand longitudinal margin of the fourth outer wall element 30.4 in FIG. 1, a bottom inner contour unit 14 is integrally formed via a connecting folding line 28. The inner contour unit has a first bottom inner wall element 40.1, a second bottom inner wall element 40.2 and a third bottom inner wall element 40.3. The bottom inner wall elements 40.1, . . . and thus also the connecting folding line 28 have a length L2, which in the exemplary embodiment is essentially half the length L1 of the outer contour unit 12. The bottom inner wall elements 40.1, . . . are connected to one another via a first and a second bottom inner folding line 42.1, 42.2.

The first bottom inner wall element 42.1 and the third bottom inner wall element 42.3 have a width B11, which is slightly smaller than the width B1 of the first and third outer wall elements 30.1, 30.3, respectively. On the underside, bottom folding tabs 70.1, 70.2 and 70.3 are integrally formed on the bottom inner wall elements 40.1, . . . via bottom folding lines 71 for forming a bottom unit 20, the center second bottom folding tab 70.2 having an insertion folding tab 73 integrally formed via an insertion folding line 75.

On the top side, a connecting folding tab 60 is integrally formed on the first bottom inner wall element 40.1 and the second inner wall element 40.3 in each case via a first connecting folding line 62 and has the width BV and the length LV. In the exemplary embodiment, the width BV corresponds to the width B11 of the first and third bottom inner wall elements 40.1, 40.3, respectively, the length LV being smaller than the width B2 of the second and fourth outer wall elements 30.2 and 30.4, respectively.

A top inner contour unit 16 is present on the top side via the two connecting folding tabs 60 and has a first, a second, a third and a fourth top wall element 50.1, 50.2, 50.3, 50.4, only the first and third top wall elements 50.1, 50.3 being attached to the connecting folding tab 60 via a second connecting folding line 64. The top inner wall elements 50.1, . . . are in each case connected to one another at their adjacent longitudinal margins via top inner folding lines 52.1, 52.2, 52.3.

The top inner folding lines 52.1, . . . , the bottom inner folding lines 42.1, . . . and the outer-contour folding lines 32.1, . . . are arranged in parallel. The width of the first and third top wall elements 50.1, 50.3 corresponds to the width B11 of the first and third bottom inner wall elements 40.1, 40.3. The width of the second and fourth top wall elements 50.2, 50.4 corresponds to the width B22 of the second bottom inner wall element 40.2.

Parallel to the first connecting folding line 62 and the second connecting folding line 64, respectively, each connecting folding tab 60 has a central inner folding line 66. The first and the second connecting folding line 62, 64 and the inner folding line 66 are arranged perpendicularly to the top and bottom inner folding lines 42.1, . . . , 52. 1, . . . , respectively. On the fourth top inner wall element 50.4 projecting to the right in FIG. 1, a top adhesive tab 54 is integrally formed on its free longitudinal margin via a top adhesive folding line 56 and has an adhesive strip 58 on the underside.

On the top side, a total of four lid folding tabs 68.1, 68.2, 68.3, 68.4 are integrally formed on the top inner contour unit 16 via lid folding lines 69 for forming a lid unit 18, the lid unit 18, in the exemplary embodiment shown, being designed as an adhesively bonded lid unit in the final state.

The top inner contour unit 16 and thus the top wall elements 50.1, . . . have a length L3, which in the exemplary embodiment corresponds to the length L2 of the bottom inner wall elements 40.1, The second top wall element 50.2 has a tear-out surface 81 which is surrounded by a circular perforation. The tear-out surface 81 is present in the region of the second top inner folding line 52.2 in such a way as to be offset upward toward the center and projects slightly beyond the second top inner folding line 52.2. There is a crescent-shaped recess 77 around this projecting region in the wall of the third top wall element 50.3. In the folded state of the folding box 10, the projecting region of the tear-out surface 81 can be taken hold of in a simple manner and the tear-out surface 81 can be separated, as a result of which a removal opening 80 is produced. The arrangement of the removal opening 80 in the longitudinal direction is selected in such a way that said removal opening 80 is covered by the outer contour unit 12 in the pushed-in state of the top inner contour unit 16 and is free in the pulled-out state of the top inner contour unit 16.

As an alternative to the adhesive strip 58, the fourth outer wall element 30.4, in its top right-hand marginal region adjacent to the third outer-contour folding line 32.3, may have an adhesive strip 36 on the top side, the length of which corresponds essentially to the length L3 of the top inner contour unit 16.

The removal opening 80 may also have another peripheral contour. It may be arranged in any desired manner in the width direction; only the arrangement in the longitudinal direction must ensure the geometric conditions for opening or closing the removal opening.

On the top side, the first outer wall element 30.1 and the third outer wall element 30.3 have a marginal opening 82 which is in the shape of an arc of a circle and is open at the top. In the folded state of the folding box 10, these marginal recesses are opposite one another on the narrow rectangular sides of the outer-periphery contour unit 12. The marginal recesses 82 ensure that the pushed-in top inner contour unit 16 can be taken hold of manually in a simple manner for pulling out.

In an embodiment variant which is not shown, there is a single connecting tab instead of the two connecting tabs 60, this single connecting tab connecting the second bottom and top inner wall elements 40.2, 50.2 to one another.

It is also possible, according to the representation shown by broken line in FIG. 1, to provide the fourth outer wall element 30.4 with a recess which runs up to the level of the top margin of the bottom inner contour unit 16.

Figure 2:
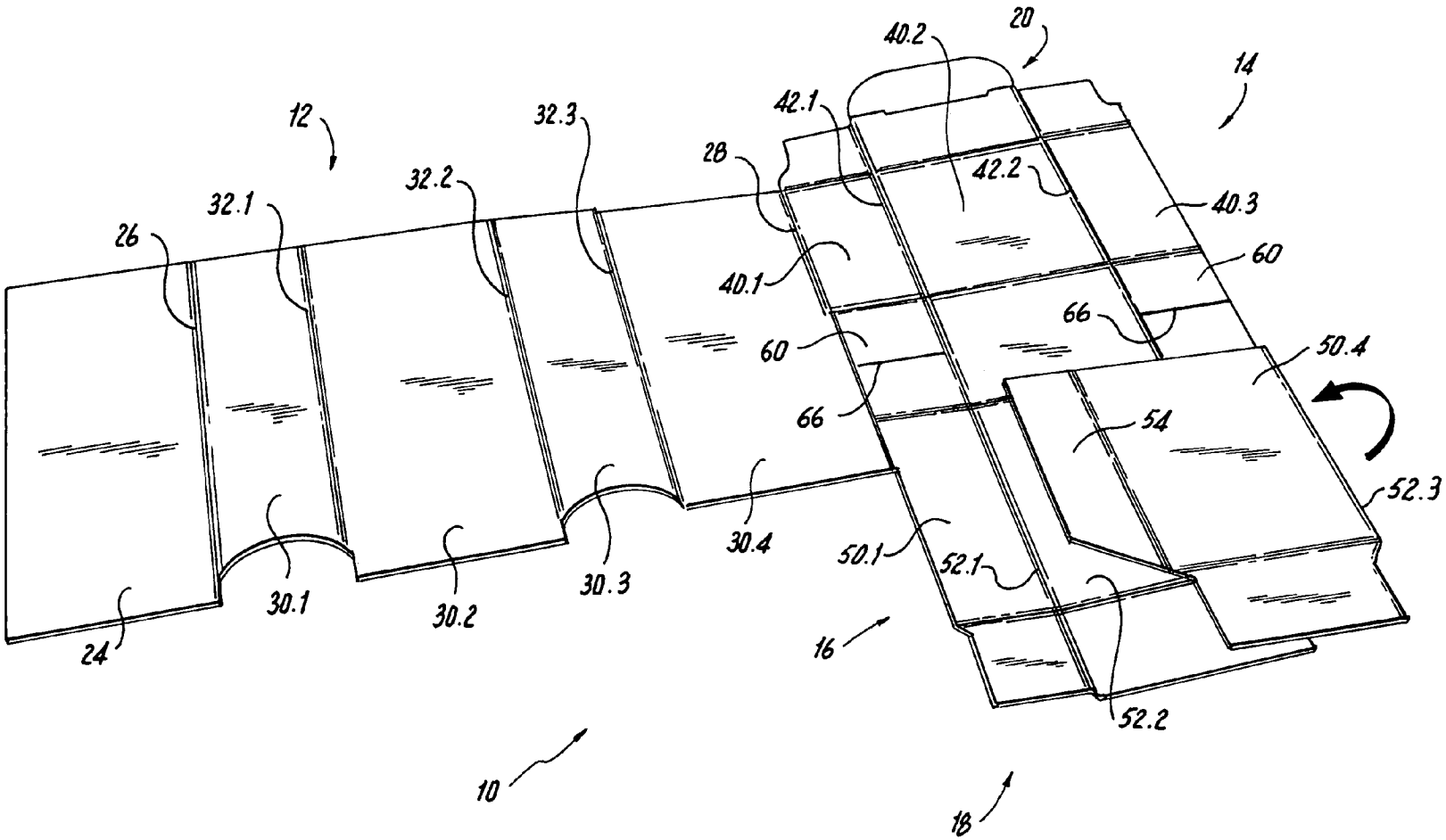
FIGS. 2–5 show perspective representations of the individual folding operations of the folding of the blank according to FIG. 1 into a flat transport state.
Figure 3:
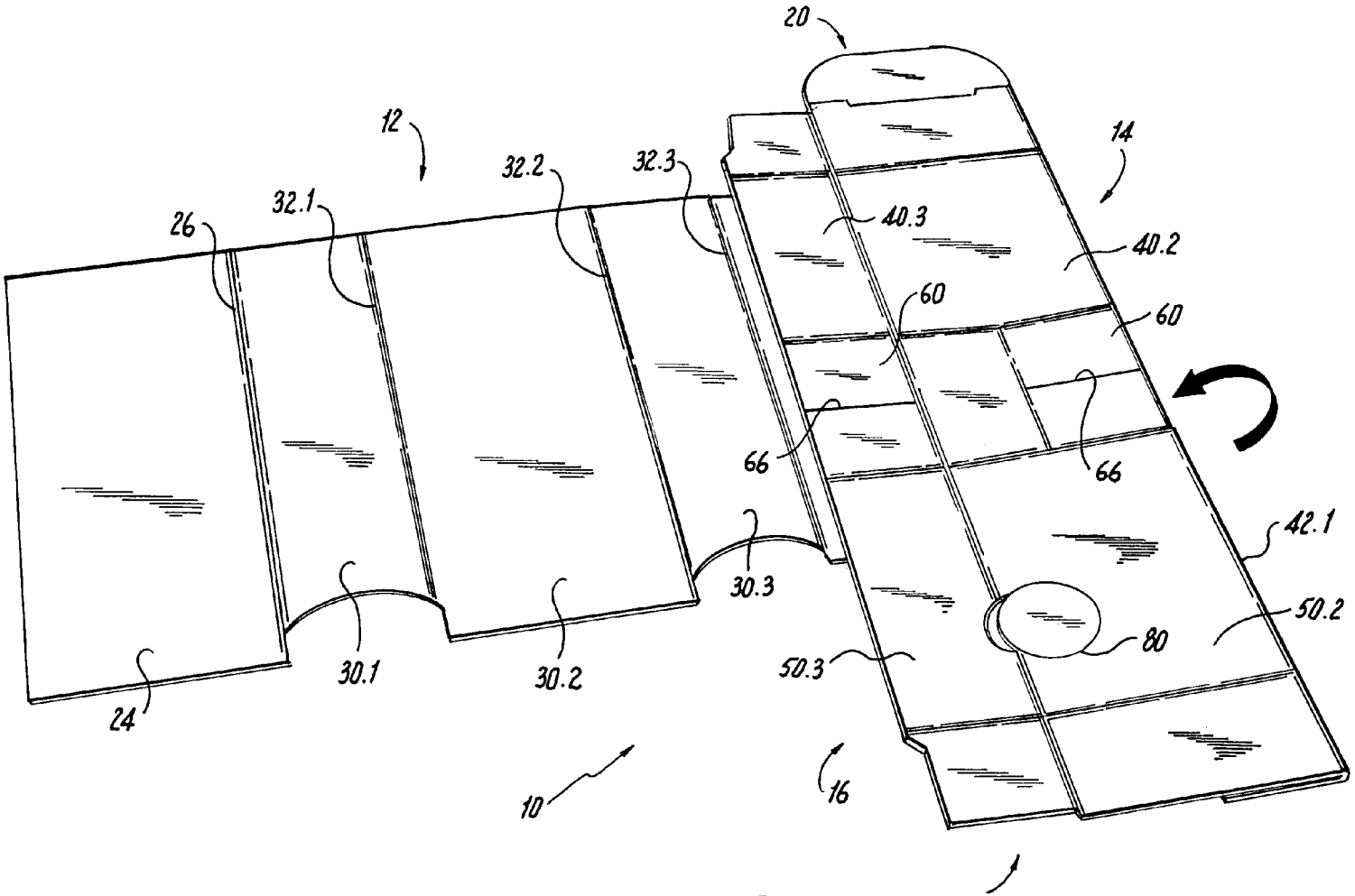

After the blank of the folding box 10 according to FIG. 1 has been produced, said folding box 10 is folded into a flat transport state and transported to the filler. This folding procedure takes place in detail as follows:

First of all the fourth top inner wall element 50.4 is folded inward about the third top inner folding line 52.3. This state is shown in FIG. 2. In a further folding step, the top and inner contour units 14, 16 are folded inward about the first top inner folding line 52.1 and the bottom inner folding line 42.1. This state is shown in FIG. 3. During this folding operation, the adhesive strip 58 is adhesively bonded to the inner wall of the first top wall element 50.1.

Figure 4:
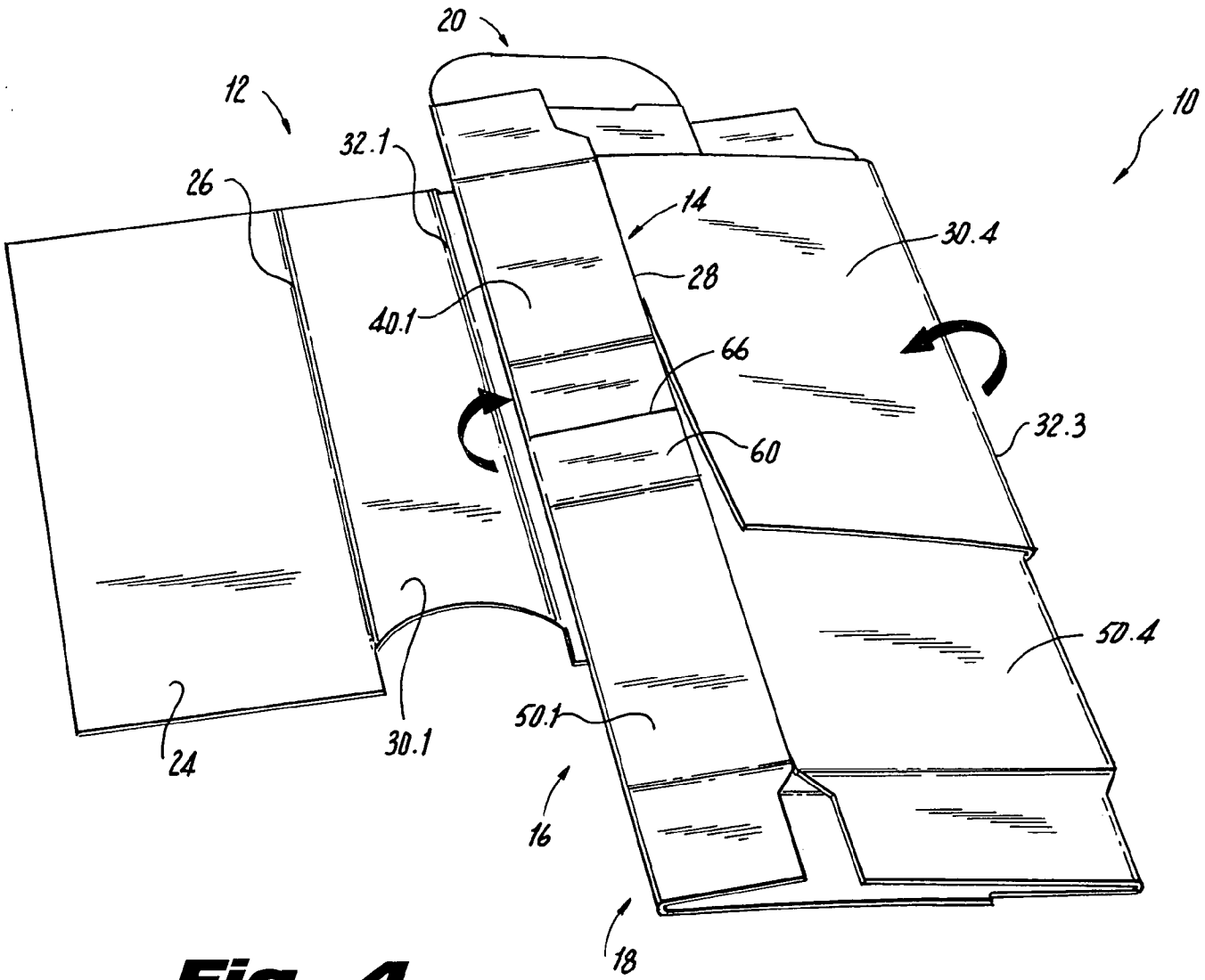

In the next folding step, the inner contour units 14, 16 are folded around the third outer-contour folding line 32.3 onto the inside of the outer contour unit 12. This state is shown in FIG. 4. In the last folding operation, the pre-folded region is folded about the first outer contour folding line 32.1 onto the first outer wall element 30.1 and onto the outer contour adhesive tab 24. In the process, the adhesive strips 34 are adhesively bonded to the outer wall of the fourth outer wall element 30.4. The flat transport state has now been reached. In this state, the folding boxes can be transported to the filler in a space-saving manner. This state is shown in FIG. 5.

Figure 5:
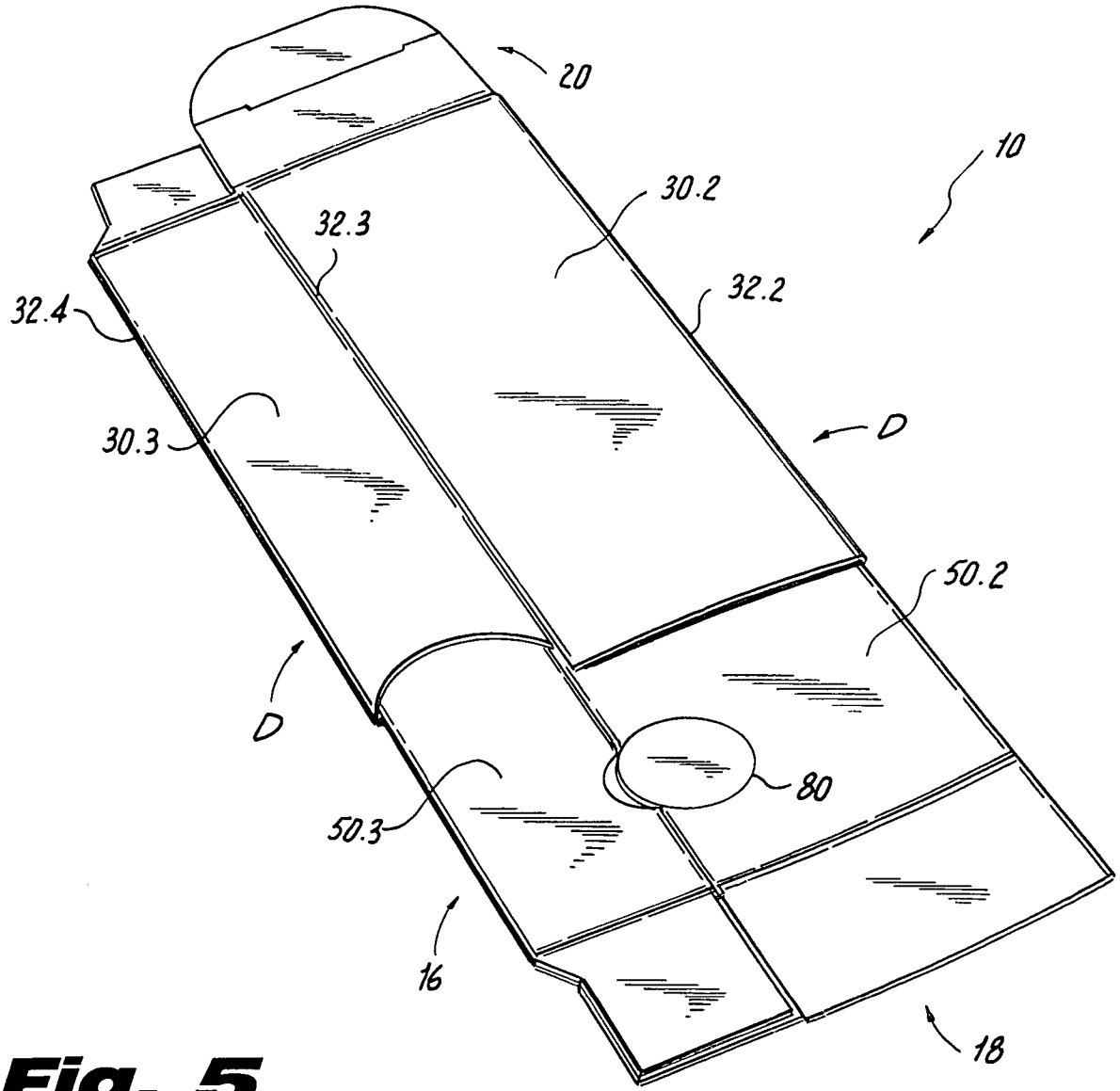
Figure 6:
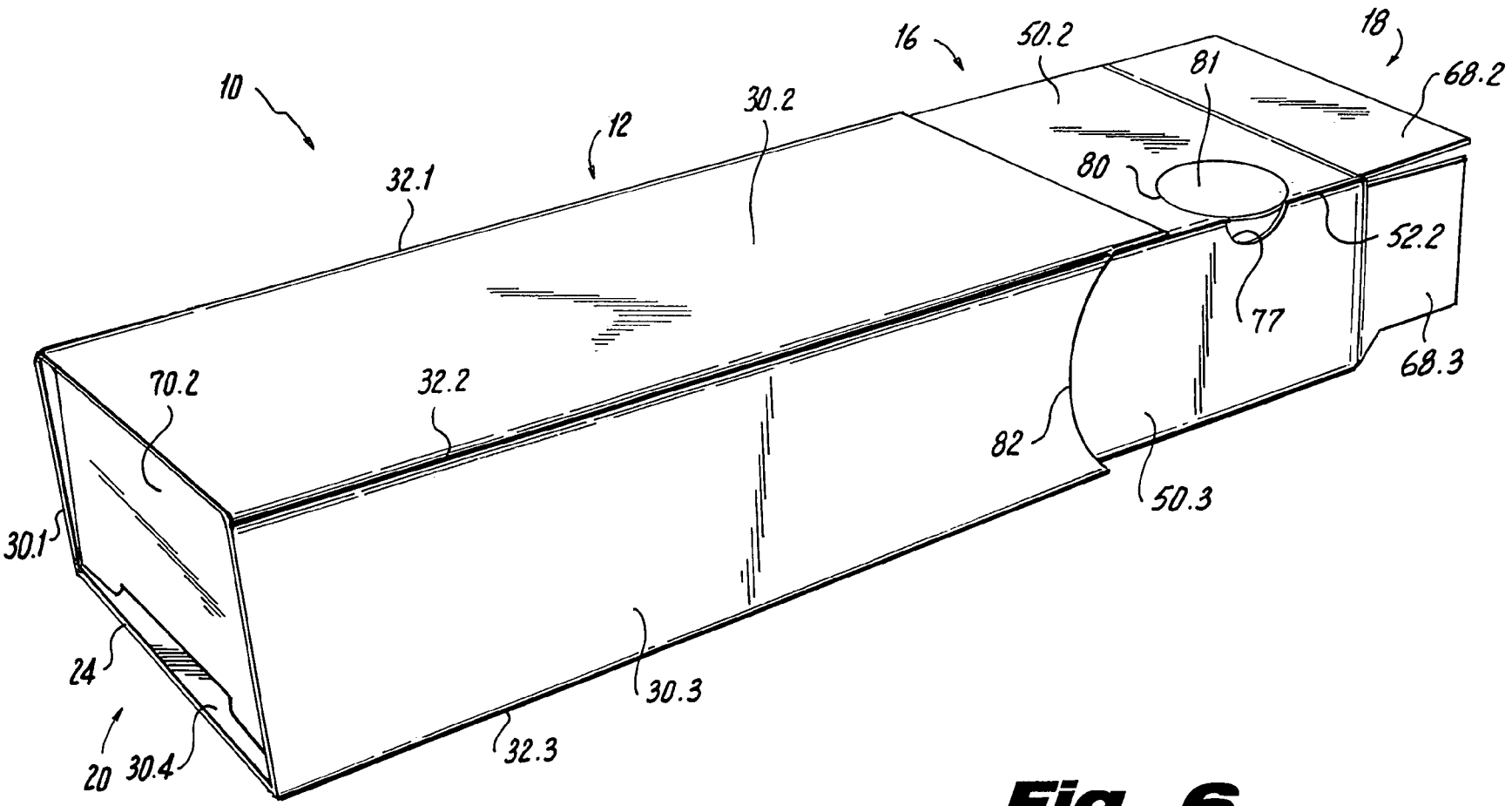
FIG. 6 shows a perspective representation of the unfolded folding box according to FIG. 5 with base unit closed and lid unit open (filling state)

To unfold the folding box, slight pressure is applied to the folding box 10 in arrow direction D according to FIG. 5. After the closing of the folding box tabs 70.1, 70.2, 70.3 with subsequent insertion of the insertion folding tab 73, the filling state shown in FIG. 6 is achieved.

Figure 7:
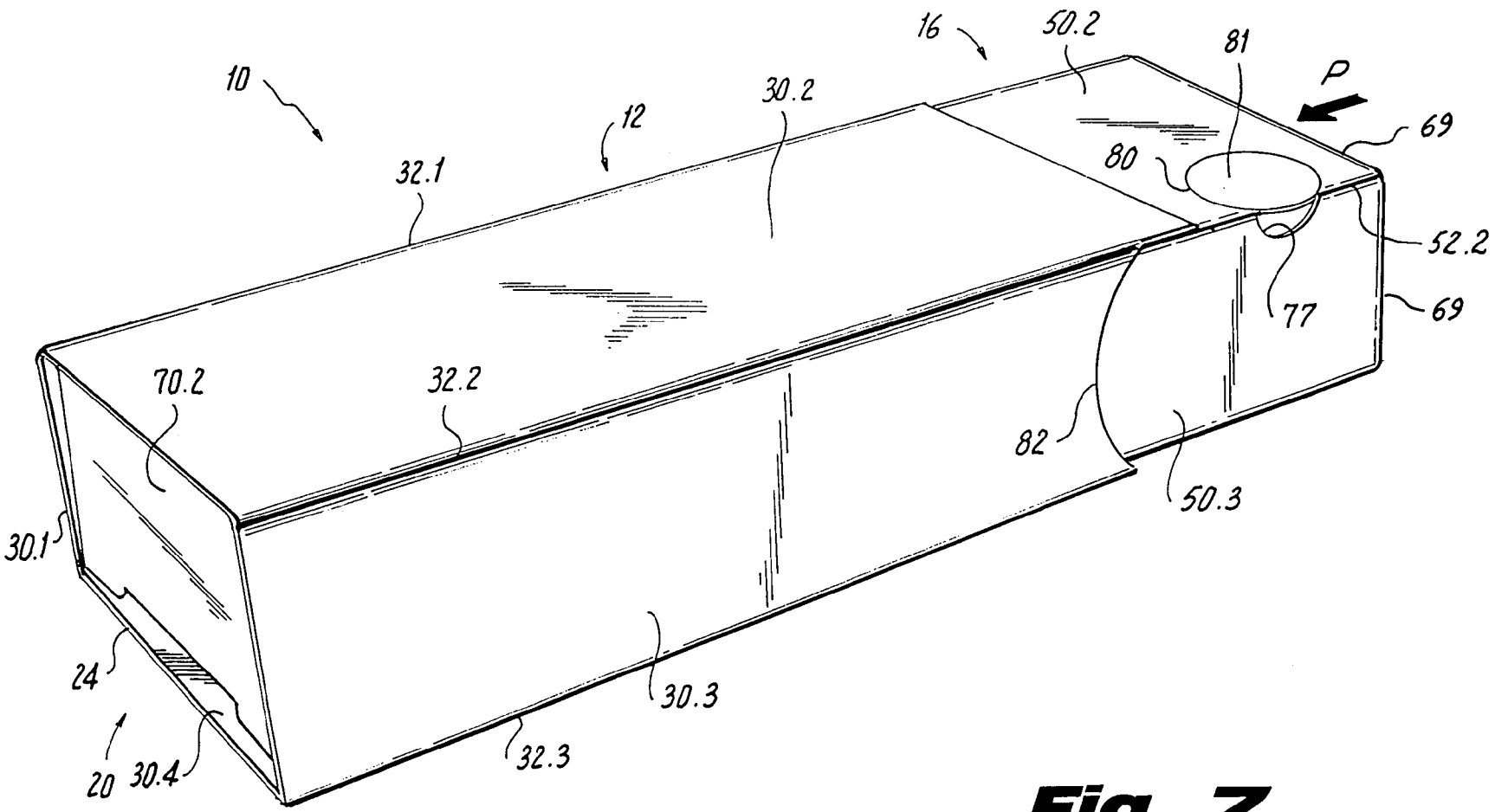
FIG. 7 shows a perspective representation of the folding box according to FIG. 6 with lid unit closed.
Figure 11:
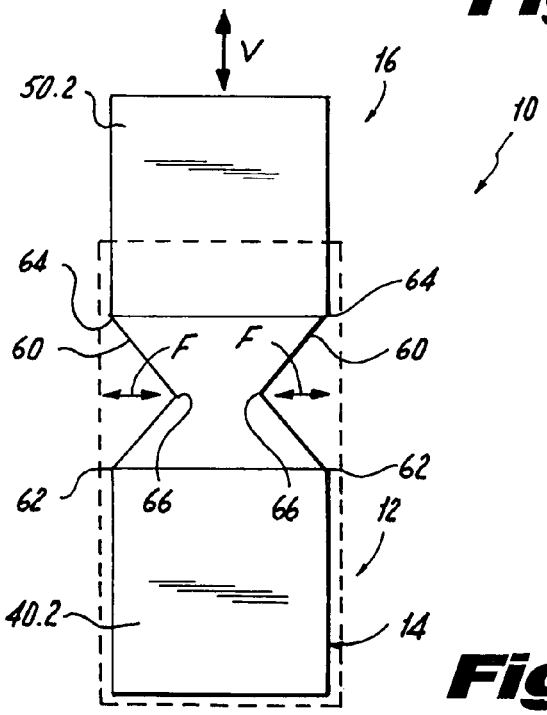
FIG. 11 shows a schematic plan view of the unfolded folding box with partly pulled-out top inner contour unit with a transparent illustration of the outer contour unit.

After the filling, the lid folding tabs 68.1, 68.2, 68.3, 68.4 are folded and adhesively bonded to one another. This state is shown in FIG. 7. The top inner contour unit 16 can now be pushed into the interior of the outer contour unit 12 by pressure in arrow direction P according to FIG. 7, in the course of which the connecting folding tabs 60 fold into the interior of the folding box 10 during this operation. This folding operation (arrows F) is schematically shown in a plan view in FIG. 11, the outer contour unit 12 being shown transparent by broken lines. The top inner contour 16 can thus be moved by the folding of the connecting folding tabs 60 (arrow V in FIG. 11).

The cross-sectional outside dimensions of the top inner contour unit 16 are dimensioned in such a way that the latter is clamped inside the outer contour unit 12, the clamping force being so great that it prevents unintentional opening on the one hand and can be overcome without any problems during manual actuation on the other hand.

The exemplary embodiment shown shows a folding box having a rectangular peripheral contour. However, other polygonal peripheral contours can also be implemented without any problems.

Figure 8:
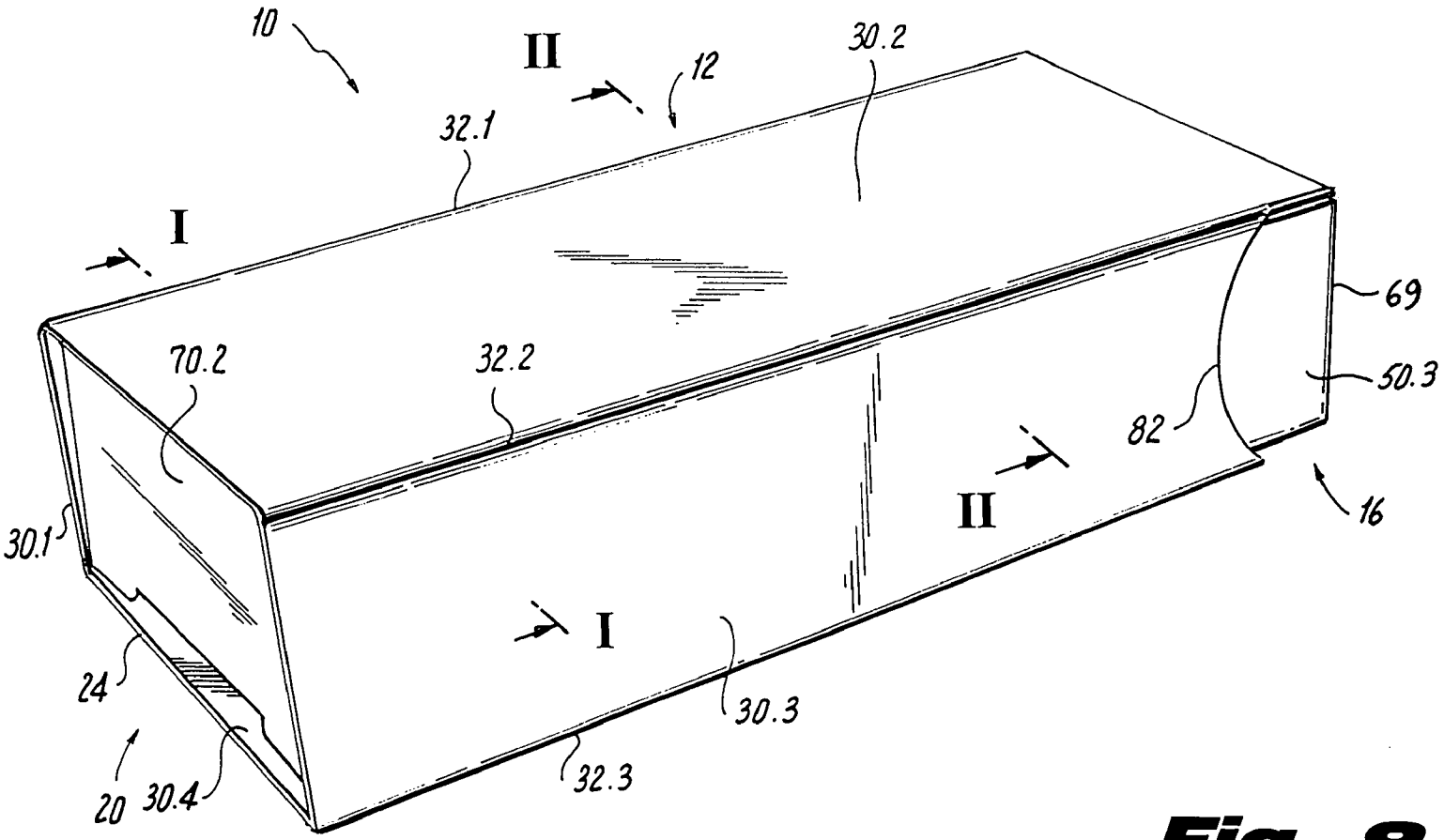
Figure 9:
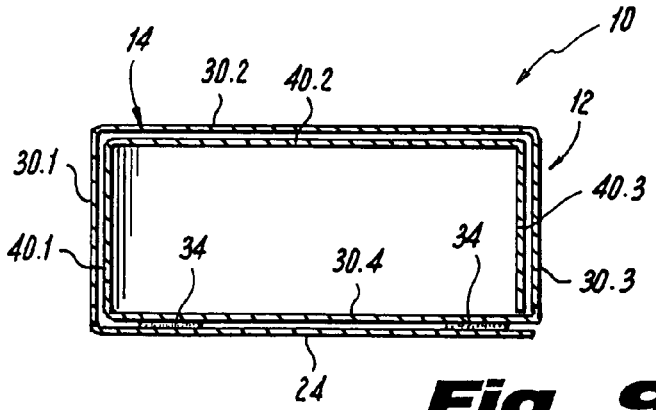
FIG. 9 shows a schematic cross section through the folding box according to FIG. 8 along section line I—I.
Figure 10:
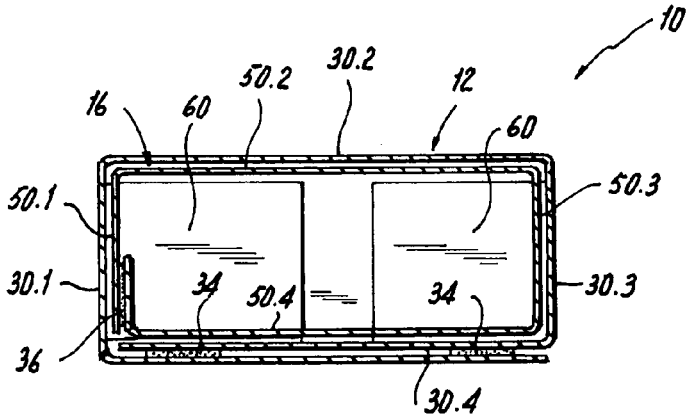
FIG. 10 shows a schematic cross section through the folding box according to FIG. 8 along section line II—II.

To remove the filling material, the outer wall of the top inner contour unit 16 is taken hold of in the region of the opposite marginal recesses 82 (shown dotted in FIG. 8) and pulled out. After the tear-out surface 81 has been torn out for the first time, the filling material can come out in portions through the removal opening 80. For closing, the top inner contour unit 16 is pushed into the interior of the outer contour unit 12 again in a simple manner. It remains held there in a releasable clamping manner on account of the clamping force present between outer wall of the top inner contour unit 16 and inner wall of the outer contour unit 12.

What is claimed is:

1. A folding box (10) having a polygonal outer contour unit (12) closed in cross section and having outer wall elements (30.1, 30.2, 30.3, 30.4) connected via outer-contour folding lines (32), a lid unit (18), a base unit (20), and a reclosable removal opening (80), which comprises a bottom inner contour unit (14), regions of which are polygonal in cross section and which has bottom inner wall elements (40.1, 40.2, 40.3) connected via bottom inner-contour folding lines (42.1, 42.2) and which is present in a folded state in the interior of the outer contour unit (12) and is connected to the outer contour unit (12) via a connecting folding line (28), a polygonal top inner contour unit (16) which is closed in cross section, has the removal opening (80) and has top inner wall elements (50.1, 50.2, 50.3, 50.4) connected via top inner-contour folding lines (52.1, 52.2, 52.3) and which is present in a folded state in the interior of the outer contour unit (12), at least one connecting folding tab (60) which connects the bottom inner contour unit (14) and the top inner contour unit (16) to one another and can be folded into the interior of the folding box (10), the folding or stretching of the connecting folding tab (60) permitting a relative displacement of the top inner contour unit (16) relative to the outer contour unit (12), the removal opening (80) being closed by the outer contour unit (12) when the top inner contour unit (16) is pushed into the outer contour unit (12), the removal opening (80) being opened in the pulled-out state of the top inner contour unit (16), and the outer contour unit (12) forming a displacement guide for the top inner contour unit (16).

2. The folding box as claimed in claim 1, wherein the sum of the lengths (L2+L3) of the top and bottom inner contour units (14, 16) essentially corresponds to the length (L1) of the outer contour unit (12).

3. The folding box as claimed in claim 1 or 2, wherein the outer contour unit (12) has at least one marginal recess (82) open at the top, so that a region of at least one top inner wall element (50.1) is accessible.

4. The folding box as claimed in claim 3, wherein there are two marginal recesses (82) on opposite outer wall elements (30.1, 30.3).

5. The folding box as claimed in claim 1 or 2, wherein an outer-contour adhesive tab (24) is attached to the outer contour unit (12) via an adhesive-tab folding line (26) and is designed as a full-surface wall element.

6. The folding box as claimed in claim 1 or 2, wherein the connecting folding tab (60) is attached to the bottom inner contour unit (14) via a first connecting folding line (62) and to the top inner contour unit (16) via a second connecting folding line (64), the connecting folding lines (62, 64) being arranged perpendicularly to the inner folding lines (42, 52).

7. The folding box as claimed in claim 1 or 2, wherein the connecting folding tab (60) has a centrally arranged inner folding line (66) which is arranged parallel to the connecting folding lines (62, 64).

8. The folding box as claimed in claim 1 or 2, wherein, lid folding tabs (68.1, . . . ) forming the lid unit (18) are integrally formed on the top inner contour unit (16) via lid folding lines (69).

9. The folding box as claimed in claim 1 or 2, wherein base folding tabs (70.1, . . . ) forming the base unit (20) are integrally formed on the bottom inner contour unit (14) via base folding lines (71).

10. The folding box as claimed in claim 1 or 2, wherein the outer contour unit (12) has a quadrilateral cross section having four outer wall elements (30.1, . . . ), the bottom inner contour unit (14) has a U-shaped cross section having three bottom inner wall elements (40.1, . . . ), and the top inner contour unit (16) has a quadrilateral cross section having four top inner wall elements (50.1, . . . ), the dimensions of the inner contour units (14, 16) being slightly smaller than the dimensions of the outer contour unit (12).

11. The folding box as claimed in claim 1 or 2, wherein the width (BV) of the connecting folding tab (60) corresponds to the width (B11) of the top and bottom inner wall elements (40.1, 50.1), respectively.

12. The folding box as claimed in claim 10, characterized in that there are two connecting folding tabs (60), which are arranged at a distance apart by the dimension of the width (B22) of an inner wall element (50.2) lying in between.

13. The folding box as claimed in claim 1 or 2, wherein the lid unit (18) is designed as an adhesively bonded lid unit.

14. The folding box as claimed in claim 1 or 2, wherein the folding box is formed from a one-piece carton blank.

15. The folding box as claimed in claim 11, characterized in that there are two connecting folding tabs (60), which are arranged at a distance apart by the dimension of the width (B22) of an inner wall element (50.2) lying in between.

* * * * *